US009784503B2

(12) United States Patent
Gärdin

(10) Patent No.: US 9,784,503 B2
(45) Date of Patent: Oct. 10, 2017

(54) OUTER COOLING LOOP

(75) Inventor: Mats Gärdin, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 340 days.

(21) Appl. No.: 13/978,199

(22) PCT Filed: Jan. 3, 2011

(86) PCT No.: PCT/EP2011/050026

§ 371 (c)(1),
(2), (4) Date: Jan. 6, 2014

(87) PCT Pub. No.: WO2012/092959

PCT Pub. Date: Jul. 12, 2012

(65) Prior Publication Data

US 2014/0127637 A1 May 8, 2014

(51) Int. Cl.
*F27D 7/06* (2006.01)
*B22F 3/00* (2006.01)
(Continued)

(52) U.S. Cl.
CPC ..... *F27D 7/06* (2013.01); *B22F 3/003* (2013.01); *B22F 3/156* (2013.01); *B30B 11/002* (2013.01); *B22F 3/15* (2013.01); *B22F 2003/153* (2013.01)

(58) Field of Classification Search
CPC ..... B22F 3/15; B22F 2003/153; B22F 3/003; B22F 3/156; B30B 11/002; F27D 7/06
(Continued)

(56) References Cited

U.S. PATENT DOCUMENTS 4,349,333 A * 9/1982 Bowles ..... B22F 3/15 165/65
5,118,289 A 6/1992 Bergman et al.
(Continued)

FOREIGN PATENT DOCUMENTS

CN 2349490 Y 11/1999
CN 2786142 3/2005
(Continued)

*Primary Examiner* — Alissa Tompkins
*Assistant Examiner* — Benjamin W Johnson
(74) *Attorney, Agent, or Firm* — Allen, Dyer, Doppelt + Gilchrist, PA

(57) ABSTRACT

The present invention relates to an arrangement for treatment of articles by hot pressing and in particular by hot isostatic pressing. The pressing arrangement includes a pressure vessel and a furnace chamber adapted to hold articles, which furnace chamber is provided inside the pressure vessel. At least one guiding passage communicating with the furnace chamber forms an outer cooling loop, wherein the pressure medium in a part of the outer cooling loop is guided in proximity to pressure vessel walls and the top end closure before it re-enters into the furnace chamber. Further, a guiding channel element is located in the at least one guiding passage forming the outer cooling loop is arranged with at least one pressure medium channel for guiding the pressure medium from a central opening of the heat insulated casing radially and circumferentially towards a lateral wall of the pressure cylinder. The at least one pressure medium channel has a substantially constant cross-sectional area in a flow direction of the pressure medium.

8 Claims, 8 Drawing Sheets

(51) Int. Cl.
*B30B 11/00* (2006.01)
*B22F 3/15* (2006.01)

(58) Field of Classification Search
USPC ..... 432/197, 199, 200, 201, 205, 206; 264/500, 519, 663, 664, 667; 425/143, 425/144
See application file for complete search history.

(56) References Cited

U.S. PATENT DOCUMENTS

| | | | | |
|---|---|---|---|---|
| 7,011,510 | B2 * | 3/2006 | Nakai | B22F 3/15 219/400 |
| 2005/0039896 | A1 * | 2/2005 | Laine | F28D 9/0012 165/157 |

FOREIGN PATENT DOCUMENTS

| | | | |
|---|---|---|---|
| CN | 201347415 | | 11/2009 |
| JP | 06011268 | | 1/1994 |
| JP | 06025711 | * | 2/1994 |
| JP | 11237186 | | 8/1999 |
| JP | 2002-373963 | | 12/2002 |
| RU | 2245221 | | 1/2005 |
| RU | 2302924 | | 7/2007 |
| SU | 97105 | | 10/1950 |
| WO | WO 2009/076973 A1 | * | 6/2009 |

* cited by examiner

OUTER COOLING LOOP

TECHNICAL FIELD OF THE INVENTION

The present invention relates to an arrangement for treatment of articles by hot pressing and in particular by hot isostatic pressing.

BACKGROUND OF THE INVENTION

Hot isostatic pressing (HIP) is a technology that finds more and more widespread use. Hot isostatic pressing is for instance used in achieving elimination of porosity in castings, such as for instance turbine blades, in order to substantially increase their service life and strength, in particular the fatigue strength. Another field of application is the manufacture of products, which are required to be fully dense and to have pore-free surfaces, by means of compressing powder.

In hot isostatic pressing, an article to be subjected to treatment by pressing is positioned in a load compartment of an insulated pressure vessel. A cycle, or treatment cycle, comprises the steps of: loading, treatment and unloading of articles, and the overall duration of the cycle is herein referred to as the cycle time. The treatment may, in turn, be divided into several portions, or states, such as a pressing state, a heating state, and a cooling state.

After loading, the vessel is sealed off and a pressure medium is introduced into the pressure vessel and the load compartment thereof. The pressure and temperature of the pressure medium is then increased, such that the article is subjected to an increased pressure and an increased temperature during a selected period of time. The temperature increase of the pressure medium, and thereby of the articles, is provided by means of a heating element or furnace arranged in a furnace chamber of the pressure vessel. The pressures, temperatures and treatment times are of course dependent on many factors, such as the material properties of the treated article, the field of application, and required quality of the treated article. The pressures and temperatures in hot isostatic pressing may typically range from 200 to 5000 bars, and preferably 800 to 200 bars, and from 300° C. to 3000° C., and preferably from 800° C. to 2000° C., respectively.

When the pressing of the articles is finished, the articles often need to be cooled before being removed, or unloaded, from the pressure vessel. In many kinds of metallurgical treatment, the cooling rate will affect the metallurgical properties. For example, thermal stress (or temperature stress) and grain growth should be minimized in order to obtain a high quality material. Thus, it is desired to cool the material homogeneously and, if possible, to control the cooling rate. Many presses known in the art suffer from slow cooling of the articles and efforts have therefore been made to reduce the cooling time of the articles.

In U.S. Pat. No. 5,118,289, there is provided a hot isostatic press adapted to rapidly cool the articles after completed pressing and heating treatment. This is achieved by using a heat exchanger, which is located above the hot zone. Thereby, the pressure medium will be cooled by the heat exchanger before it makes contact with the pressure vessel wall. Consequently, the heat exchanger allows for an increased cooling capacity without the risk of, for example, overheating the wall of the pressure vessel. However, since the heat exchanger is located close to the top closure of the pressure vessel there is a risk that the cooling capability of the heat exchanges is impaired due to undesired heating of the heat exchanges caused by ascending thermal energy within the pressure vessel. Therefore, it may be desirable to enhance the cooling capability of the heat exchanger. It is well known within the art that an increased flow rate of the pressure medium entails an enhanced cooling due to an increased heat transfer coefficient. In U.S. Pat. No. 5,118,289, an increased flow rate is achieved by allowing the circulating gas (pressure medium) to pass the heat exchanger via a pump of fan or the like. This solution may, on the other hand, add complexity to the construction of the pressing arrangement as well as it may increase maintenance requirements and needs.

Hence, there is still a need within the art of an improved pressing arrangement for hot isostatic pressing that is capable of controlled rapid cooling of articles and of pressure medium.

SUMMARY OF THE INVENTION

A general object of the present invention is to provide an improved pressing arrangement, which is capable of a controlled and rapid cooling of articles being treated in the pressing arrangement and of the pressure medium during hot isostatic pressing.

A further object of the present invention is to provide an improved pressing arrangement, which is capable of such controlled rapid cooling without special purpose equipment such as fans or pumps for the cooling.

Another object of the present invention is to provide an improved pressing arrangement with reduced maintenance requirements.

Yet another object of the present invention is to provide an improved pressing arrangement, which is capable of high temperature uniformity during, for example, the pressing state and the steady-state.

Still another object of the present invention is to provide an improved pressing arrangement in which the risk of overheating the pressure vessel is significantly reduced in comparison to prior art pressing arrangements for hot isostatic pressing.

These and other objects of the present invention are achieved by means of a pressing arrangement having the features defined in the independent claims. Embodiments of the present invention are characterized in the dependent claims.

In the context of the present invention, the term "heat exchanging unit" refers to a unit capable of storing thermal energy and exchanging thermal energy with the surrounding environment.

Furthermore, in the context of the present invention, the terms "cold" and "hot" or "warm" (e.g. cold and warm or hot pressure medium or cold and warm or hot temperature) should be interpreted in a sense of average temperature within the pressure vessel. Similarly, the term "low" and high" temperature should also be interpreted in a sense of average temperature within the pressure vessel.

According to a main aspect of the present invention, there is provided a pressing arrangement for hot pressing, comprising a pressure vessel including a pressure cylinder provided with top and bottom end closures. A furnace chamber adapted to hold articles is provided inside the pressure vessel and is at least party enclosed by a heat insulated casing. At least one guiding passage communicating with the furnace chamber forms an outer cooling loop, wherein the pressure medium in a part of the outer cooling loop is guided in proximity to pressure vessel walls and the top end closure before it re-enters into the furnace chamber.

Further, a guiding channel element is located in the at least one guiding passage forming the outer cooling loop is arranged with at least one pressure medium channel for guiding the pressure medium from a central opening of the heat insulated casing radially and circumferentially towards a lateral wall of the pressure cylinder. The at least one pressure medium channel has a substantially constant cross-sectional area in a flow direction of the pressure medium over its entire length.

Generally, the present invention is based on the idea of utilizing passages and spaces of an outer cooling loop for the pressure medium which cannot be used for carrying load to enhance the cooling capabilities of the pressing arrangement.

According to a main aspect of the present invention, this is achieved by providing a guiding channel element in the outer cooling loop above the furnace chamber close to or in contact with the top end closure. The guiding channel element is arranged with pressure medium channels designed with a cross-section area and a curvature in a radial and circumferential direction such that a high and substantially constant speed of the pressure medium is obtained during its passage through the guiding channel element. Due to the high and constant speed of the pressure medium during its passage close to the top end closure, the heat transfer ratio can be maintained at a high rate during the entire passage through the guiding channel element and thereby, in turn, the thermal energy that can be transmitted from the pressure medium during its passage of the guiding channel element to the top end closure.

An even further improved cooling capability can be achieved by arranging heat exchanging or heat sink elements in passages or spaces in the outer cooling loop, for example, in connection with the guiding channel element or in proximity to the lateral wall of the pressure vessel. Thereby, an enhanced cooling capability can be achieved at the same time as no additional space is occupied by the heat exchanging elements. That is, the space occupied by the heat exchanging elements does not compete with load carrying space. In conventional pressure arrangements these passages and spaces are only used for guiding or passing pressure medium. The present invention therefore provides an enhanced cooling capability without having to use valuable load space.

In preferred embodiments, the guiding channel element itself is made of a material having heat exchanging or heat sink capabilities.

The amount of thermal energy transferred via the top end closure depends inter alia on:

- The speed of the pressure medium during its passage through the channels of the guiding channel element;
- The amount of pressure medium having contact with the top end closure during its passage through the channels of the guiding channel element;
- The relative temperature difference between the pressure medium and the guiding channel element;
- The material of the guiding channel element;
- The design of the heat exchanging element, for example, the surface of the guiding channel element being exposed to the passing pressure medium.

Features from two or more embodiments outlined above can be combined, unless they are clearly complementary, in further embodiments. Likewise, the fact that two features are recited in different claim does not preclude that they can be combined to advantage.

The different embodiments of the present invention described herein can be combined, alone or in different combinations, with embodiments in different combinations described in the patent applications "Non-uniform cylinder" and "Pressing arrangement" filed on the same day as the present application by the same applicant. The content of the patent applications "Non-uniform cylinder" and "Pressing arrangement", respectively, are included herein by reference.

BRIEF DESCRIPTION OF FIGURES

Embodiments of the present invention will now be described with reference to the accompanying drawings, on which.

DETAILED DESCRIPTION OF EMBODIMENTS

Figure 1:
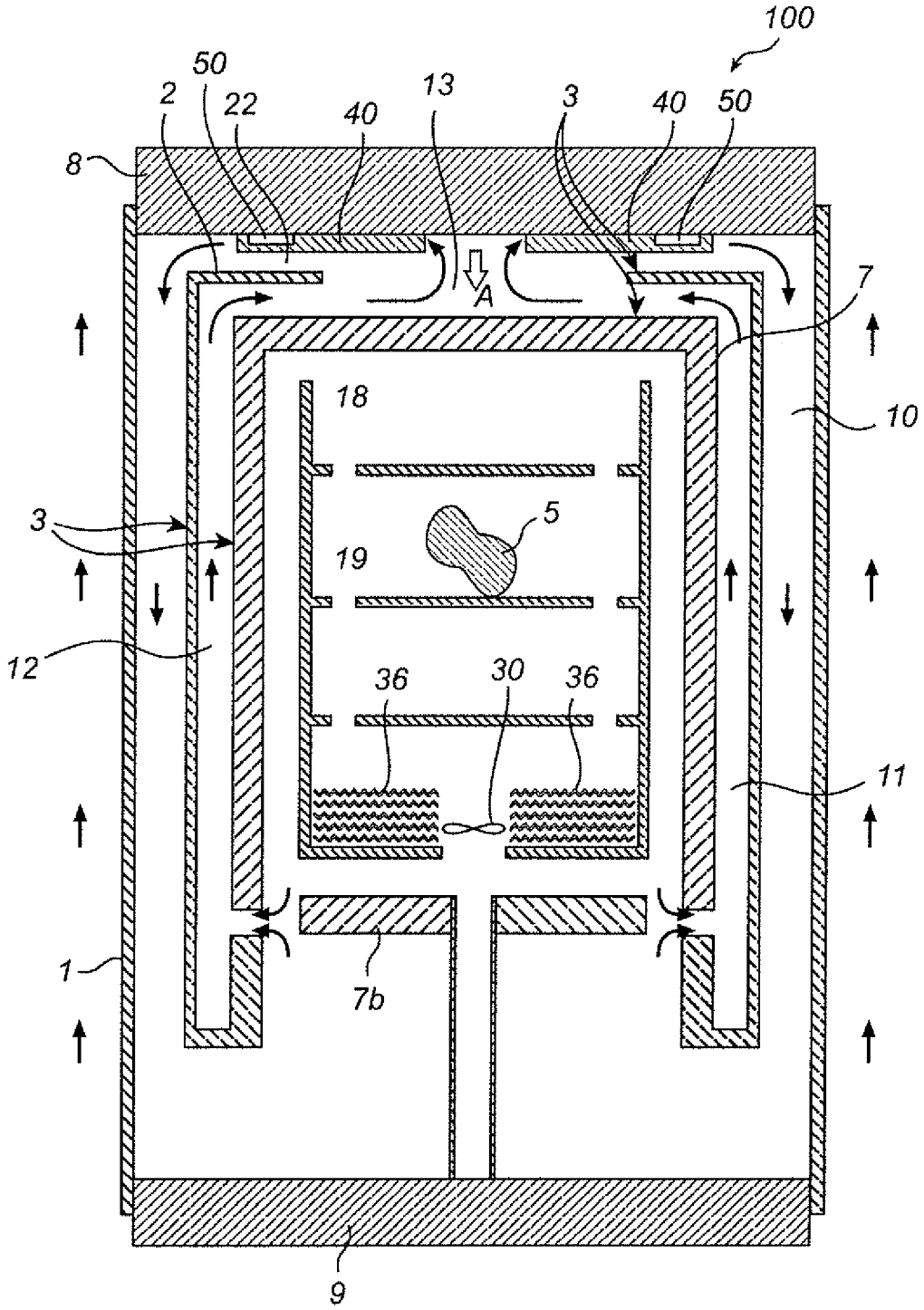
FIG. 1 is a schematical side view of a pressing arrangement in which an embodiment of the present invention is implemented.

The following is a description of exemplifying embodiments of the present invention. This description is intended for the purpose of explanation only and is not to be taken in a limiting sense. It should be noted that the drawings are schematic and that the pressing arrangements of the described embodiments comprise features and elements that are, for the sake of simplicity, not indicated in the drawings.

Embodiments of the pressing arrangement according to the present invention may be used to treat articles made from a number of different possible materials by pressing, in particular by hot isostatic pressing.

With reference first to FIG. 1, a pressure arrangement in which the present invention is implemented will be discussed. The pressing arrangement 100, which is intended to be used for pressing of articles, comprises a pressure vessel 1 with means (not shown), such as one or more ports, inlets and outlets, for supplying and discharging a pressure medium. The pressure vessel 1 is provided with top and bottom end closures 8 and 9, respectively.

The pressure medium may be a liquid or gaseous medium with low chemical affinity in relation to the articles to be treated. The pressure vessel 1 includes a furnace chamber 18, which comprises a furnace (or heater) 36, or heating elements, for heating of the pressure medium during the pressing state of the treatment cycle. The furnace 36 may, as shown in for example FIG. 1, be located at the lower portion of the furnace chamber 18, or may be located at the sides of the furnace chamber 18 (not shown). The person skilled in the art realizes that it is also possible to combine heating elements at the sides with heating elements at the bottom so as to achieve a furnace which is located at the sides and at the bottom of the furnace chamber. Clearly, any implementation of the furnace regarding placement of heating elements, known in the art, may be applied to the embodiments shown herein. It is to be noted that the term "furnace" refers to the means for heating, while the term "furnace chamber" refers to the volume in which load and furnace are located. The furnace chamber 18 does not occupy the entire pressure vessel 1, but leaves an intermediate space or first guiding passage 10 around it. The first guiding passage 10 is used as guiding passage in an outer cooling loop as indicated in FIG. 1 by the arrows. During normal operation of the pressing arrangement, the first guiding passage 10 is typically cooler than the furnace chamber 18 but is at equal pressure.

The furnace chamber 18 further includes a load compartment 19 for receiving and holding articles 5 to be treated. The furnace chamber 18 is surrounded by a heat insulated casing 3, which is likely to save energy during the heating state. It may also ensure that convection takes place in a more ordered manner. In particular, because of the vertically elongated shape of the furnace chamber 18, the heat insulated casing 3 may prevent forming of horizontal temperature gradients, which are difficult to monitor and control. The bottom of the heat insulated casing 3 comprises a bottom heat insulating portion 7*b*. Fittings inside the pressure vessel 1—including the load compartment 19, casing 3, heat insulating portion 7*b*, any apertures between the furnace chamber 18 and the first guiding passage 10 and even adjustable valves—will form guiding flow channels or otherwise play the role as guiding means for streams of pressure medium when such arise as a consequence of convective or forced flow. It should be noted, that the disclosed layout of the fittings may be varied in a number of ways, e.g., to satisfy specific needs.

Furthermore, the pressure vessel 1 may be provided with one or more cooling circuits including channels or tubes, in which a coolant for cooling may be provided. In this manner, the vessel wall may be cooled in order to protect it from detrimental heat. The flow of coolant is indicated in FIG. 1 by the arrows on the outside of the pressure vessel. The use of an external cooling circuit enables efficient cooling even though the pressure vessel can be carefully heat insulated for energy-economical operation. Preferably, the guiding means are arranged in such manner that the pump forces a convective circulation loop of which a substantive portion is proximate to the externally cooled outer wall of the pressure vessel. This causes heat transfer away from the hot articles and out of the pressure vessel.

The heat-insulated casing 3 of the furnace chamber 18 is accompanied by a housing 2, which includes a top aperture 13, for adding another layer to the circulation loop. A guiding passage 11 is formed between the housing 2 of the furnace chamber 18 and the heat insulating portion 7 of the furnace chamber 18. The second guiding passage 11 is used to guide the pressure medium towards the top end closure 8 of the pressure vessel (or alternatively towards the pressure vessel wall, which is not shown herein) via the top aperture 3. Thus, in addition to the internal circulation inside the furnace chamber 18, the pressure medium is guided substantially upwards in the guiding passage 11 formed between the casing 3 and the housing 2, and substantially downwards in the first guiding passage 10, between the housing and the outer wall of the pressure vessel 1 in an outer cooling loop. It is noted that one portion of the internal circulation is guided back into the furnace chamber 18, whereas a second portion joins the upward flow between the housing 2 and the casing 3, and a third portion flows directly into the intermediate space 10. The proportion of these three flows can be adjusted by varying the spacing between a bottom heat insulating portion 7*b*, the housing 2 and the casing 3.

A guiding channel element 40 is arranged in the space 22 a above the housing 2 and below the upper lid 8. The guiding channel element 40 is arranged with at least one channel 50 (see FIG. 2*a* and FIG. 2*b*) for guiding the pressure medium from the central opening 13 of the heat insulated casing 3 radially and circumferentially towards a lateral wall of the pressure cylinder 1. The at least one channel 50 has a cross-section geometry and a curvature in a radial and circumferential direction such that a velocity of the pressure medium during its passage through the at least one channel 50 is substantially constant.

However, it is also conceivable that each channel 50 has a specific cross-sectional area being constant over the length of the channel, i.e. it is not necessary that all the channels have the same cross-sectional area.

Figure 3:
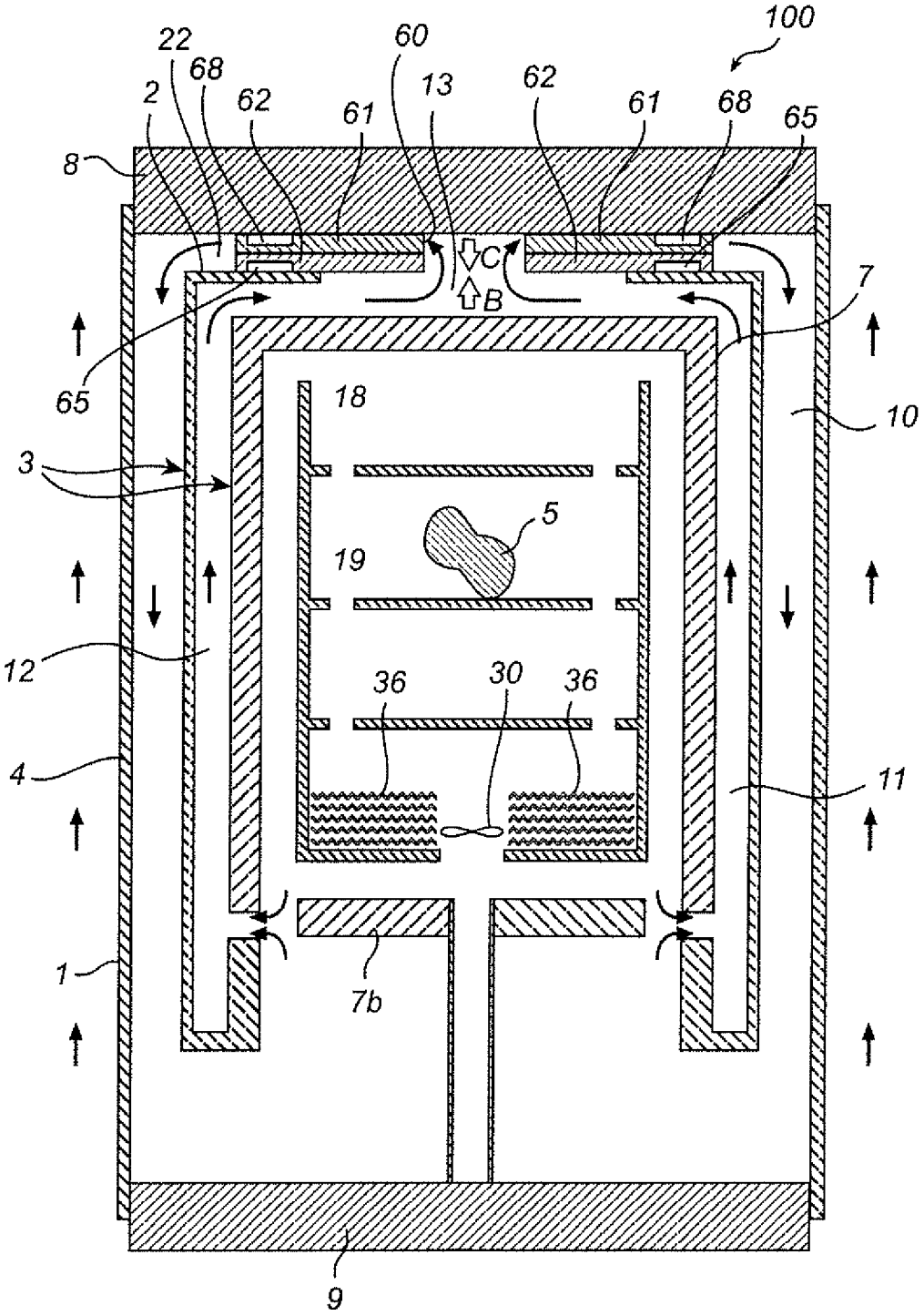
FIG. 3 is a schematical side view of a pressing arrangement provided by the applicant in which another embodiment of the present invention is implemented.
Figure 4A:
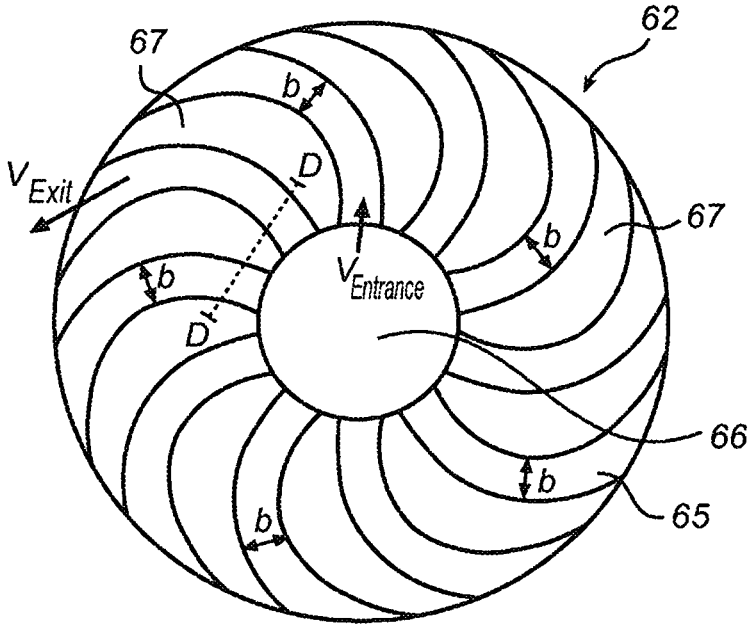
FIG. 4*a* is a detailed and schematical view of a guiding channel element according to another embodiment of the present invention.
Figure 4B:
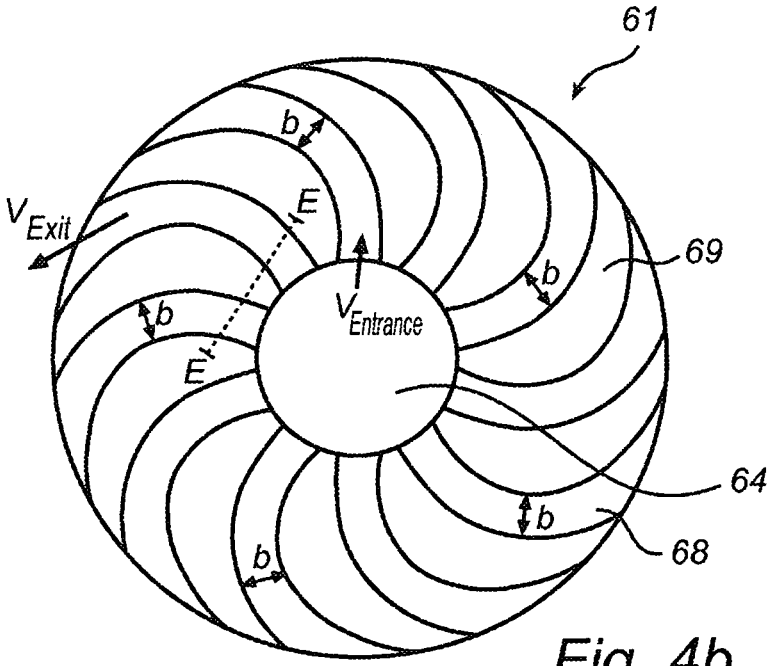
FIG. 4*b* is a detailed and schematical view of the guiding channel element shown in FIG. 4*a;*
Figure 4C:
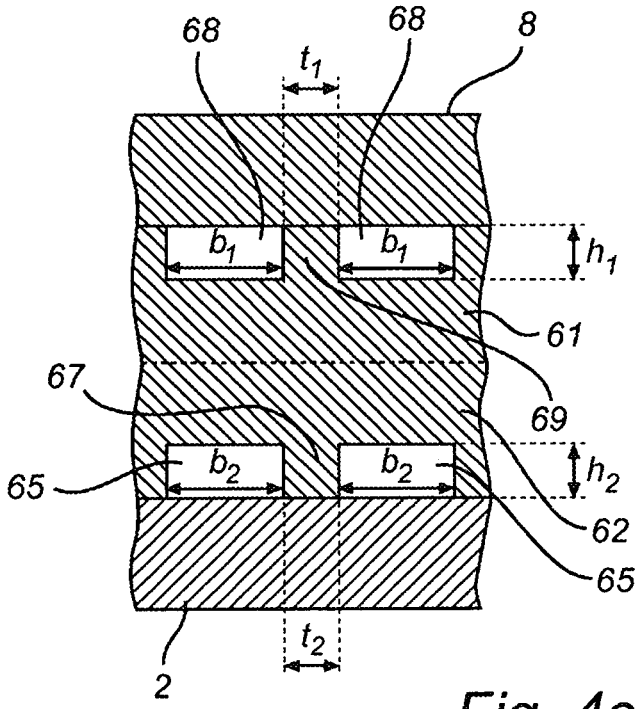
FIG. 4*c* is a detailed and schematical cross-sectional view of the guiding channel element shown in FIGS. 4*a* and 4*b;*
Figure 7:
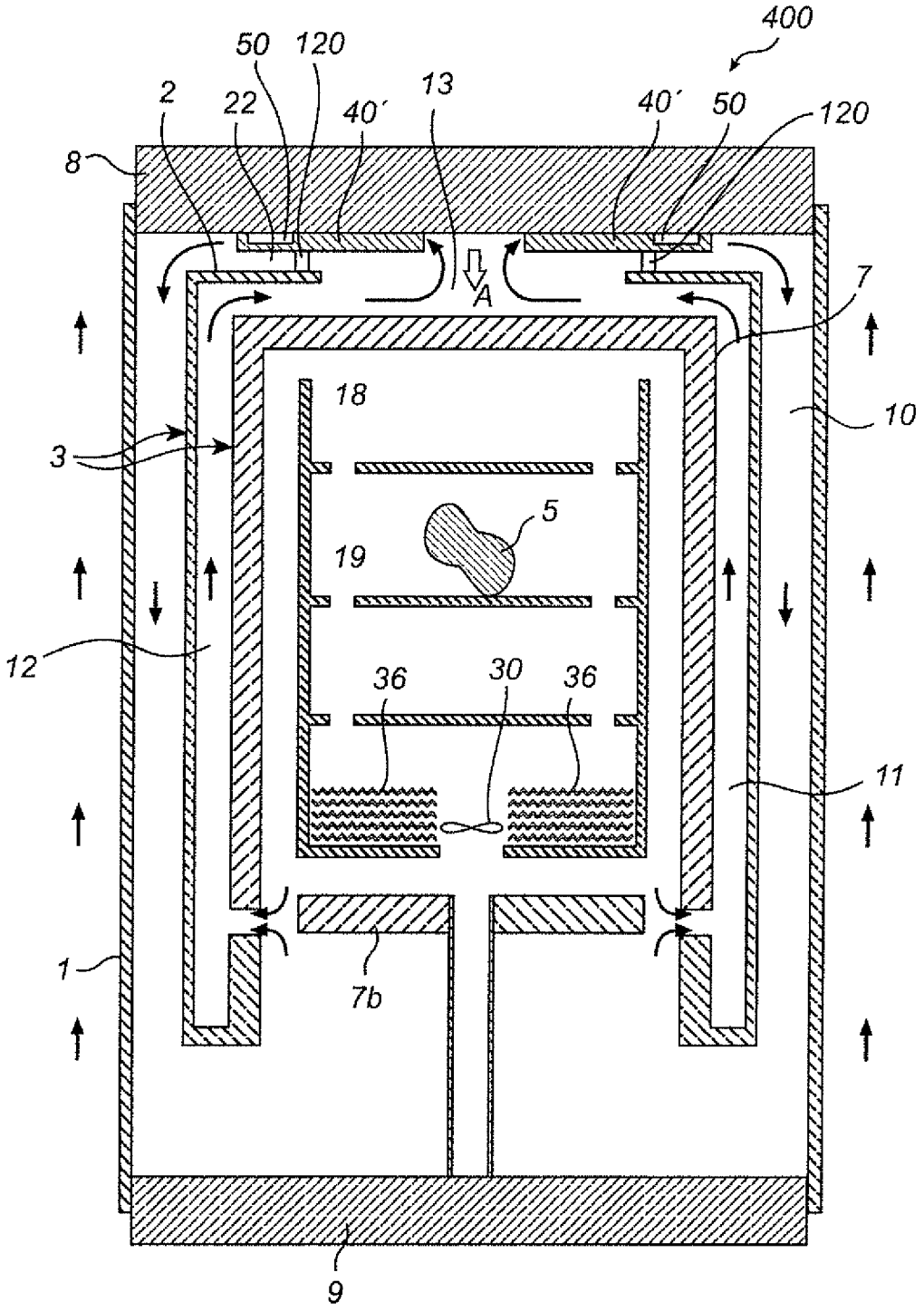
FIG. 7 a schematical view of a pressing arrangement in which yet another embodiment of the present invention is implemented.

By securing that the guiding channel element 40 is pressed against the upper lid 8, an efficient transfer of thermal energy from the pressure medium to the upper lid 8 can be achieved. In the embodiment shown in FIG. 1, the guiding channel element 40 is attached to upper lid 8 by attachment means, for example, by using screws. According to other embodiments (shown in FIGS. 3 and 4*a*-4*c*) this can be achieved by, as shown in FIG. 3, by constructing the guiding channel element with a thickness corresponding to the space 22 between the housing 2 and the upper lid 8 or, as shown in FIG. 4, by arranging spring elements on the guiding channel element to provide a force pressing the guiding channel element against the upper lid 8. In a further embodiment of a pressing arrangement 400, as shown in FIG. 7, a guiding channel element 40' is pressed against or held in place in abutment against the upper lid 8 by support means 120. The support means 120 may comprise rigid support rods capable of holding the guiding channel element 40' in place in a non-resilient manner or spring elements capable of holding the guiding channel element 40' in place in a resilient manner. The support means 120 may be attached to the guiding channel element 40' or in the housing 2.

Figure 2A:
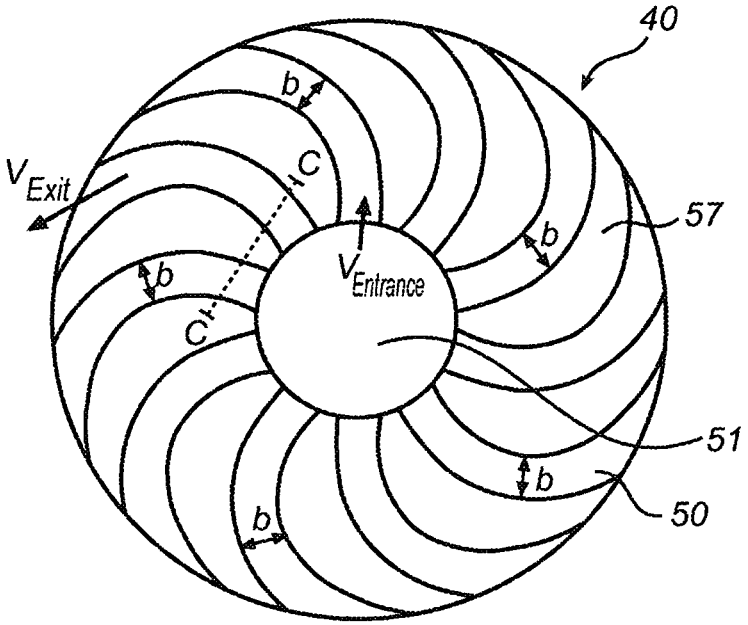
FIG. 2*a* is a detailed and schematical view of a guiding channel element according to an embodiment of the present invention.
Figure 2B:
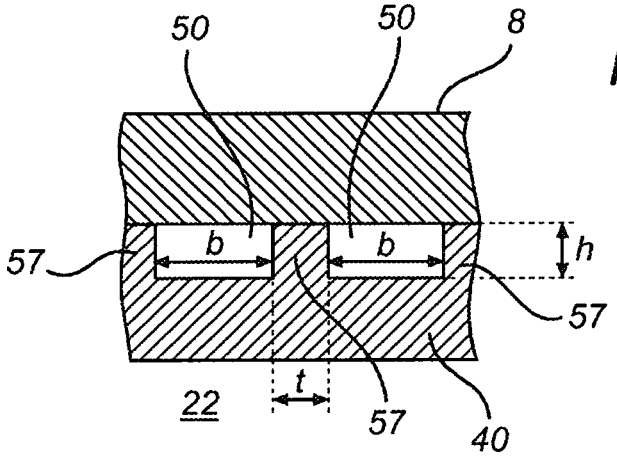
FIG. 2*b* is a detailed and schematical cross-sectional view of the guiding channel element shown in FIG. 2*a;*

In FIG. 2*a*, a view of the guiding channel element 40 seen in a direction of the arrow A in FIG. 1 is shown. The pressure medium enters the channels 50 separated by walls 57 via a central opening 51 of the guiding channel element. In this embodiment five channels are provided but however an arbitrary number of channels may be provided. The central opening 51 of the guiding channel element is arranged to allow the pressure medium flowing through the central opening 13 to enter into the channels 50 via the central opening 51 of the guiding channel element 40. The channels 50 have preferably the same width, b, and the same height, h, (see FIG. 2*b*) over the entire length of respective channel 50, and, hence, the same area over the entire length. Thereby, the entrance velocity of the pressure medium, $V_{Entrance}$, will be approximately the same as the exit velocity, $V_{Exit}$ at a given flow velocity of the pressure medium at entrance into the central opening 51 of the guiding channel element 40. In FIG. 2*b*, a cross-sectional view of the guiding channel element 40 along the line C-C in FIG. 2*a* is shown. The cross-sectional area (A=b×h) of the channels 50 is substantially constant over the entire length of the respective channels 50. In this embodiment, the thickness, t, of the walls 57 is the same for all walls 57 of the guiding channel element 50.

With reference now to FIG. 3, another embodiment of the present invention will be discussed. Like or corresponding parts of the pressing arrangement shown in FIG. 1 will be omitted in the following description. According to this embodiment, a guiding channel element 60 having an upper part 61 and a lower part 62 is arranged in the space 22 above the housing 2. The lower part 62 includes at least one channel 65, see FIGS. 4*a* and 4*c*, arranged to guide pressure medium radially and circumferentially outwards from the central opening 13 of the heat insulated casing 3 toward a lateral wall of the pressure vessel 1. In FIG. 4*a*, a view of the lower part 62 is shown in a direction of the arrow B. The pressure medium enters the channels 65 separated by walls 67 via a central opening 66 of the lower part 62 of the guiding channel element 60. In this embodiment, five channels are provided but however an arbitrary number of channels may be provided. The central opening 66 of the guiding channel element is arranged to allow the pressure medium flowing through the central opening 13 to enter into the channels 65 via the central opening 66 of the guiding channel element 60. The at least one channel 65 is arranged with a cross-section geometry and a curvature in a radial and circumferential direction such that the pressure medium is guided radially and circumferentially outwards toward a lateral wall of the pressure vessel 1 at a substantially constant velocity. The at least one channel 65 is defined by walls 67 of the lower part 62 and, in this embodiment, the housing 2. The walls 67 of the lower part 62 may function as heat exchanger elements. The channels 65 have preferably the same width, $b_2$, and the same height, $h_2$, (see FIG. 4*c*) over the entire length of respective channel 65, and, hence, the same area over the entire length.

The upper part 61 includes at least one channel 68, see FIGS. 4*b* and 4*c*, arranged with a cross-section geometry and a curvature in a radial and circumferential direction such that the pressure medium is guided radially and circumferentially outwards toward a lateral wall of the pressure vessel 1 at a substantially constant velocity. The at least one channel 68 is defined by walls 69 of the upper part 61 and the top end closure 8. The channels 68 have preferably the same width, $b_1$, and the same height, $h_1$, (see FIG. 4*c*) over the entire length of respective channel 68, and, hence, the same area over the entire length.

In FIG. 4*c*, a cross-sectional view of the guiding channel element 60 along the line D-D in FIG. 4*a* and line E-E in FIG. 4*b* is shown. The cross-sectional area ($A_1=b_1 \times h_1$) of the channels 68 is substantially constant over the entire length of the respective channels 68. In this embodiment, the thickness, $t_2$, of the walls 69 is the same for all walls 69 of the upper part 61 of the guiding channel element 60.

In FIG. 4*a*, a view of the lower part 62 of guiding channel element 60 seen in a direction of the arrow C in FIG. 3 is shown. The pressure medium enters the channels 65, in this embodiment five channels are provided but however an arbitrary number of channels may be provided, via a central opening 64 of the guiding channel element. The central opening 64 of the guiding channel element 60 is arranged to allow the pressure medium flowing through the central opening 13 of the housing 2 to enter into the channels 65 via the central opening 64 of the guiding channel element 60. The channels 65 have the same width, $b_2$, and the same height, $h_2$, (see FIG. 4*b*) over the entire length of respective channel 65, and, hence, the same area over the entire length. Thereby, the entrance velocity of the pressure medium, $V_{Entrance}$, will be approximately the same as the exit velocity, $V_{Exit}$ at given conditions including a given flow velocity of the pressure medium at entrance into the central opening 64 of the guiding channel element 60.

In FIG. 4*c*, a cross-sectional view of the guiding channel element 60 along the line D-D in FIG. 4*a* and line E-E in FIG. 4*b* is shown. The cross-sectional area ($A_2=b_2 \times h_2$) of the channels 65 is substantially constant over the entire length of the respective channels 65. In this embodiment, the thickness, $t_2$, of the walls 67 is the same for all walls 67 of the lower part 62 of the guiding channel element 60.

The channel area $A_1$ and the channel area $A_2$ do not have to be the same but may differ in some embodiments. Furthermore, the channels 65 and 68 are shown in FIG. 4*c* to be parallel, which is not necessary. Thus, the channels 65 and 68 may be arranged in, for example, an overlapping pattern.

Figure 5:
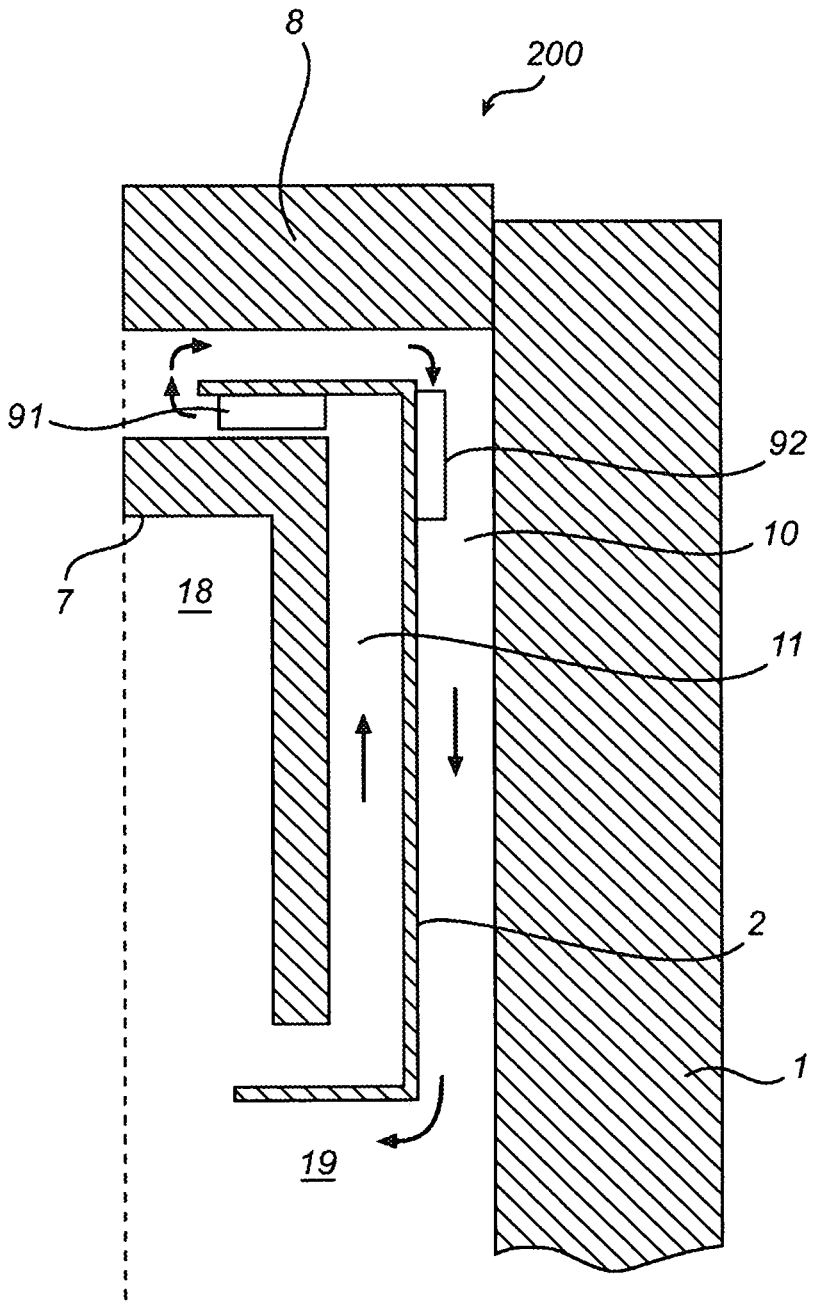
FIG. 5 is detailed and schematical view of another embodiment of the present inventions implemented in a pressing arrangement.
Figure 6:
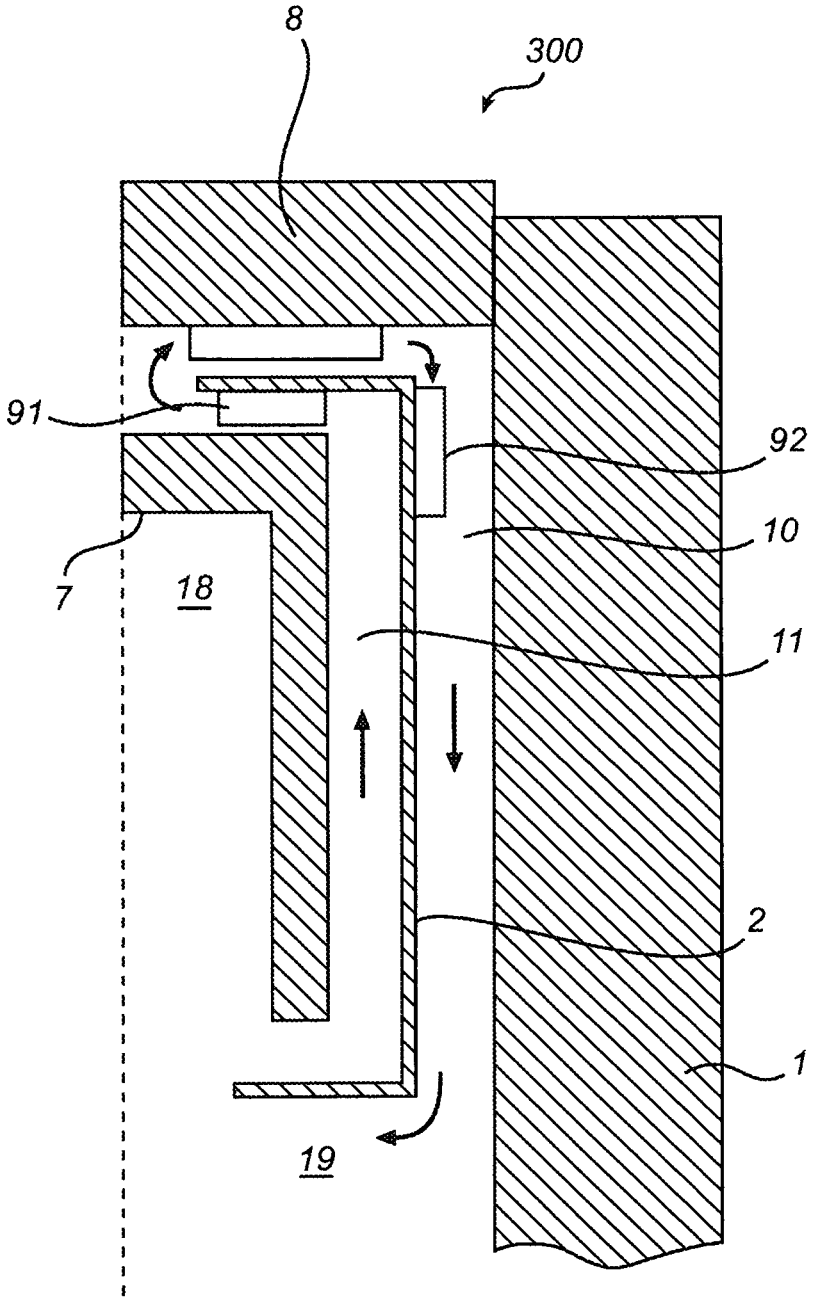
FIG. 6 is detailed and schematical view of a further embodiment of the present inventions implemented in a pressing arrangement.

With reference to FIG. 5, a further embodiment of the present invention will be discussed. FIG. 5 is a detailed cut-out view of a pressing arrangement 200. In this embodiment, heat exchanging elements 91 and 92 are arranged in an outer cooling loop 10, 11 of the pressure vessel 100. The heat exchanging elements 91 and 92 may be combined with the guiding channel elements 40 or 60 described above. An example is shown in FIG. 6.

The heat exchanging elements 91 and 92 are arranged in spaces and/or passages of the outer cooling loop 10, 11 that cannot be used for other purposes such as loading articles 5. Thereby, by utilizing these otherwise unused spaces and/or passages for locating heat exchanging elements the cooling capabilities of the pressure arrangement 100 can be improved at the same time as the loading capabilities of the pressure arrangement 100 can be maintained.

The arrows indicate the flow of pressure medium during, for example, a cooling phase. A first heat exchanging element 92 is arranged in the first guiding passage 10, between the housing 2 and the outer wall of the pressure vessel 1. Further, a second heat exchanging element 91 is arranged in the second guiding passage 11 formed between the housing 2 of the furnace chamber 18 and the heat insulating portion 7 of the furnace chamber 18. The second guiding passage 11 is used to guide the pressure medium towards the top of the pressure vessel (or alternatively towards the pressure vessel wall, which is not shown herein). Further heat exchanging elements (not shown) may be arranged in a space 19 below the housing 2.

The heat exchanging elements or heat sink elements 91 and 92 are arranged completely inside the pressure vessel and is not supplied with any external cooling medium. Hence, the heat exchanging elements 91 and 92 have no physical connection with the environment outside the pressure vessel 1.

Because the heat exchanging element 91 and 92 are arranged in the outer cooling loop 10, 11, the cooling can be enhanced since thermal energy is transferred to the heat exchanging elements 91 and 92 from the pressure medium passing through and/or by the heat exchanging elements 91 and 92 in addition to the transmission of thermal energy from the pressure medium descending through the guiding passage 10 through the vessel wall into the cooling circuit (not shown) outside the vessel wall.

The amount of thermal energy transferred to a heat exchanging element depends inter alia on the following:

- The relative temperature difference between the pressure medium and the heat exchanging element;
- The size of the heat exchanging element;

The material of the heat exchanging element;

The design of the heat exchanging element, for example, the surface of the heat exchanging element being exposed to the passing pressure medium; and The location of the heat exchanging element in, for example, the guiding passage.

With reference now to FIG. 6, another embodiment a pressing arrangement 300 of the present invention is shown. The heat exchanging elements 91 and 92 are, in this embodiment, combined with the guiding channel element 40 as described above with reference to FIGS. 1, 2*a*, and 2*b*.

As the skilled person realizes, the number of heat exchanging elements, their respective placements and their relative sizes of the elements illustrated in FIGS. 5 and 6 are only exemplifying.

Even though the present description and drawings disclose embodiments and examples, including selections of components, materials, temperature ranges, pressure ranges, etc., the invention is not restricted to these specific examples. Numerous modifications and variations can be made without departing from the scope of the present invention, which is defined by the accompanying claims.

The invention claimed is:

1. A pressing arrangement for hot pressing, comprising:

a pressure vessel comprising a pressure cylinder provided with top and bottom end closures;

a furnace chamber adapted to hold articles, said furnace chamber being at least partly enclosed by a heat insulated casing and with said furnace chamber being positioned inside said pressure vessel, wherein the furnace chamber is arranged so that a pressure medium can enter and exit the furnace chamber;

a plurality of guiding passages communicating with said furnace chamber and adapted to form an outer cooling loop, the plurality of guiding passages comprising first and second guiding passages, wherein the heat insulated casing comprises a heat insulating portion and a housing at least partly enclosing the heat insulating portion, wherein a part of the outer cooling loop comprises the first guiding passage which is formed between the housing and the heat insulating portion and which is arranged to guide the pressure medium after having exited the furnace chamber towards the top end closure via a central opening of the housing, and wherein the pressure medium in another part of said outer cooling loop after having exited the furnace chamber is guided in proximity to pressure vessel walls and said top end closure before re-entering into said furnace chamber;

a guiding channel element located in the second guiding passage comprised in the other part of the outer cooling loop, said guiding channel element being arranged in abutment against said top end closure and being arranged with at least one channel for guiding the pressure medium from the central opening of the housing radially and circumferentially towards a lateral wall of said pressure cylinder, wherein said at least one channel forms an enclosed passage for the pressure medium, and with said at least one channel of said guiding channel element having a substantially constant cross-section area in a flow direction of the pressure medium over an entire length of said at least one channel, and with said at least one channel of said guiding channel element having a curvature in a radial and circumferential direction over its entire length; and a plurality of elements arranged so as to provide a force acting on the guiding channel element so as to press the guiding channel element in a direction towards the top end closure, thereby pressing the guiding channel element such that it only makes contact against the top end closure.

2. The pressing arrangement according to claim 1, wherein said at least one pressure medium channel is delimited by walls of said guiding channel element and said top end closure, wherein the pressure medium during its passage through the pressure medium channel at least partly is in contact with said top end closure.

3. The pressing arrangement according to claim 1, wherein the guiding channel element comprises:

a lower part including at least one pressure medium channel arranged to guide the pressure medium radially and circumferentially outwards from the central opening of the heat insulated casing toward a lateral wall of the pressure vessel, said at least one channel being arranged with a substantially constant cross-section area over a length of said at least one channel, with said at least one channel being partly delimited by walls of said lower part; and an upper part including at least one pressure medium channel arranged with a substantially constant cross-section area over a length of said at least one channel and being arranged to guide the pressure medium radially and circumferentially outwards toward a lateral wall of the pressure vessel, with said at least one channel of said upper part being delimited by walls of said upper part and said top end closure.

4. The pressing arrangement according to claim 1, wherein said at least one pressure medium channel is arranged with a cross-sectional area in a flow direction of the pressure medium that is constant over the entire channel length in said flow direction.

5. The pressing arrangement according to claim 2, wherein said at least one pressure medium channel is arranged with a cross-sectional area in a flow direction of the pressure medium that is constant over the entire channel length in said flow direction.

6. The pressing arrangement according to claim 3, wherein at least one of said at least one pressure medium channel of the lower part and said at least one pressure medium channel of the upper part is arranged with a cross-sectional area in a flow direction of the pressure medium that is constant over the entire channel length in said flow direction.

7. The pressing arrangement according to claim 1, wherein said at least one pressure medium channel has an evolvent geometry.

8. A pressing arrangement for hot pressing, comprising:

a pressure vessel including a pressure cylinder provided with top and bottom end closures;

a furnace chamber adapted to hold articles, the furnace chamber being at least partly enclosed by a heat insulated casing and which furnace chamber is provided inside the pressure vessel, wherein the furnace chamber is arranged so that pressure medium can enter and exit the furnace chamber;

a plurality of guiding passages communicating with the furnace chamber and adapted to form an outer cooling loop, the plurality of guiding passages comprising first and second guiding passages, wherein the heat insulated casing comprises a heat insulating portion and a housing at least partly enclosing the heat insulating portion, wherein a part of the outer cooling loop comprises the first guiding passage which is formed between the housing and the heat insulating portion and which is arranged to guide the pressure medium after having exited the furnace chamber towards the top end closure via a central opening of the housing, and wherein the pressure medium in another part of said outer cooling loop after having exited the furnace chamber is guided in proximity to pressure vessel walls and said top end closure before it re-enters into said furnace chamber; and a guiding channel element located in the second guiding passage comprised in the other part of the outer cooling loop, said guiding channel element being arranged in abutment against said top end closure and being arranged with at least one channel for guiding said pressure medium from the central opening of the housing radially and circumferentially towards a lateral wall of said pressure cylinder, wherein said at least one channel forms an enclosed passage for pressure medium, wherein the guiding channel element is arranged so such that it only contacts the top end closure, and wherein said at least one channel of said guiding channel element has a substantially constant cross-section area in a flow direction of said pressure medium over an entire length of said at least one channel, and wherein said at least one channel of said guiding channel element has a curvature in a radial and circumferential direction over its entire length.

* * * * *